US007177732B2

(12) United States Patent
Kraeling et al.

(10) Patent No.: US 7,177,732 B2
(45) Date of Patent: Feb. 13, 2007

(54) AUTOMATIC COUPLING OF LOCOMOTIVE TO RAILCARS

(75) Inventors: Mark Bradshaw Kraeling, Melbourne, FL (US); David Carroll Teeter, Satellite Beach, FL (US); David Frank Kornick, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 159 days.

(21) Appl. No.: 10/360,055

(22) Filed: Feb. 6, 2003

(65) Prior Publication Data

US 2003/0182030 A1 Sep. 25, 2003

Related U.S. Application Data

(60) Provisional application No. 60/365,575, filed on Mar. 19, 2002.

(51) Int. Cl.

| | |
|---|---|
| ***G05D 1/00*** | (2006.01) |
| ***B61G 7/00*** | (2006.01) |
| ***B60L 3/08*** | (2006.01) |
| *G06F 17/00* | (2006.01) |
| *B60L 3/10* | (2006.01) |

(52) U.S. Cl. ..... 701/19; 701/20; 303/7; 303/22.6

(58) Field of Classification Search ..... 701/19, 701/17, 20; 246/187 A, 182 B, 167 R, 168.1, 246/187 C, 187 R; 213/1.3, 75 R, 76; 303/139, 303/142, 128, 132, 7, 22.6, 22.7; 318/52; 180/197

See application file for complete search history.

(56) References Cited

U.S. PATENT DOCUMENTS

| | | | | |
|---|---|---|---|---|
| 3,385,964 A | | 5/1968 | Chejan et al. | 246/182 BH |
| 4,838,173 A | * | 6/1989 | Schroeder et al. | 105/35 |
| 5,325,700 A | * | 7/1994 | Litten | 73/11.06 |
| 5,511,749 A | * | 4/1996 | Horst et al. | 246/187 A |
| 5,758,848 A | * | 6/1998 | Beule | 246/182 B |
| 5,950,967 A | * | 9/1999 | Montgomery | 246/182 R |
| 5,986,579 A | * | 11/1999 | Halvorson | 340/933 |
| 6,273,521 B1 | * | 8/2001 | Halvorson et al. | 303/7 |
| 6,314,345 B1 | * | 11/2001 | Coombes | 701/19 |
| 6,525,647 B1 | * | 2/2003 | Calamatas | 340/5.8 |
| 2002/0072833 A1 | * | 6/2002 | Gray | 701/19 |
| 2003/0205927 A1 | * | 11/2003 | Kettle | 303/7 |
| 2004/0089192 A1 | * | 5/2004 | Jacob | 105/215.2 |

FOREIGN PATENT DOCUMENTS

| | | | |
|---|---|---|---|
| GB | 1183071 | | 3/1970 |
| JP | 54149114 A | * | 11/1979 |

* cited by examiner

*Primary Examiner*—Thomas Black
*Assistant Examiner*—Christine M. Behncke
(74) *Attorney, Agent, or Firm*—Carlos L. Hanze; Beusse Wolter Sanks Mora & Marie, P.A.; David G. Maire

(57) ABSTRACT

An automatic coupling system (10) for a locomotive (11). The automatic coupling system includes a means for detecting a coupling contact and for controlling locomotive systems such as throttle and brakes in response to such contact. The means for detecting contact may be a speed sensor (24), an accelerometer (26), a distance detector (28), and/or a wheel slip detector (30). The automatic coupling system may be integrated with a locomotive remote control system (22) to facilitate the coupling of a locomotive to a railcar (40) when the operator is not located in the locomotive cab.

28 Claims, 2 Drawing Sheets

AUTOMATIC COUPLING OF LOCOMOTIVE TO RAILCARS

This application claims benefit of the Mar. 19, 2002, filing date of U.S. provisional patent application Ser. No. 60/365,575, incorporated herein by reference.

FIELD OF THE INVENTION

This invention relates generally to the field of rail transportation, and more particularly to a system and method for controlling a locomotive during coupling of a train that includes at least the locomotive to a railcar.

BACKGROUND OF THE INVENTION

A railroad locomotive may be coupled to a railcar by motoring the locomotive into the railcar at a relative speed of about two miles per hour to engage the respective couplers on the locomotive and the railcar. Once coupling has been achieved, the throttle setting of the locomotive must be reduced to avoid spinning of the locomotive drive wheels, since the speed of the locomotive will be suddenly reduced as a result of the contact with the railcar. The reduction in speed of the locomotive will be a function of the relative mass of the locomotive plus any railcars already moving with the locomotive to the mass of the railcar being coupled and any other railcars already coupled to that railcar. For example, a locomotive being coupled to a single empty railcar will experience a relatively small speed decrease due to the contact with the railcar, whereas a locomotive being coupled to a long string of heavily loaded railcars will experience a more dramatic decrease in speed upon being coupled.

A locomotive engineer must pay attention to the distance between the locomotive and the railcar to be coupled in order to be prepared to reduce the throttle upon making contact. This activity can distract the engineer from other activities that can affect the safe and/or efficient operation of the locomotive. The task of coupling is made even more difficult if the engineer is operating the locomotive by remote control, as is often done in rail switching yards using a locomotive remote control system such as those sold by Canac, Inc. of Montreal, Canada, under the trademark Beltpack. Remote control systems generally utilize a transmitter unit remote from the locomotive that allows an operator to send commands or control signals to the receiver unit on the locomotive. The receiver unit then implements the commands for control systems of the locomotive, such as the braking system, throttle, and the like. While an engineer riding on a locomotive can actually feel the impact made with the coupled car, an operator of a remote control system has no such sense of feel and must rely on visual and audio observations only. This can be extremely difficult when the locomotive being controlled is operating at a substantial distance from the location of the operator.

BRIEF SUMMARY OF THE INVENTION

Thus, an improved apparatus and method for controlling a locomotive during coupling of a train that includes at least the locomotive with a railcar is desired.

A coupling control apparatus for controlling a locomotive upon coupling to a railcar is described herein as including: a sensor for monitoring one or more parameters indicative of coupling to a railcar and generating a signal; and a controller for controlling the locomotive based on the signal. The signal is based on at least one of a change in speed of the locomotive, a change in acceleration of the locomotive, wheel slip detected on the locomotive, or a distance measurement between a locomotive (or train) and a railcar. At least one sensor is included for providing the signal indicative of coupling to a railcar. The sensor comprises a speed sensor, an accelerometer, a wheel slip sensor, and/or a distance detector. The controller is operative to slow the locomotive upon coupling to the railcar. This is accomplished by the controller communicating with a throttle control device for controlling the throttle of the locomotive and/or a brake control device for controlling the brake of the locomotive. The controller also generates and communicates an output signal upon coupling to the railcar and/or with an automatic coupler to indicate that the coupling has been made.

The controller may further include programmed instructions for detecting change in the signal upon coupling to the railcar so that the controller is operative to effect a change in the speed of the locomotive responsive to this change of signal. The signal is based on a change in speed of the locomotive or a change in acceleration of the locomotive.

The apparatus may further include a communication module for communicating with a remote device wherein the remote device transmits a signal to activate and deactivate the coupling control apparatus. The controller also transmits a signal to the remote device upon coupling to the railcar.

A remote control apparatus for a locomotive is also described herein as including: an operator control unit; a sensor for generating a signal indicative of coupling to a railcar; and a controller responsive to the operator control unit and the signal for controlling the operation of a locomotive.

A method for controlling a locomotive upon coupling to a railcar is described as including the steps of: (a) generating a signal indicative of coupling between a locomotive and a railcar; and (b) controlling the locomotive based on the signal. The signal is based on one or more of a change in speed of the locomotive, a change in acceleration of the locomotive, and/or wheel slip detected on the locomotive. Controlling the locomotive includes generating commands to locomotive systems to slow the locomotive upon coupling to the railcar.

The locomotive is controlled relative to a magnitude of change in the signal. Further, the signal may be based on a distance measurement between a locomotive and a railcar to indicate distance to impact and the distance measurement between the locomotive and the railcar is adjusted to account for any intermediate railcars already coupled thereto to indicate distance to impact. Data representative of the number of intermediate railcars is automatically or manually incremented upon coupling.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
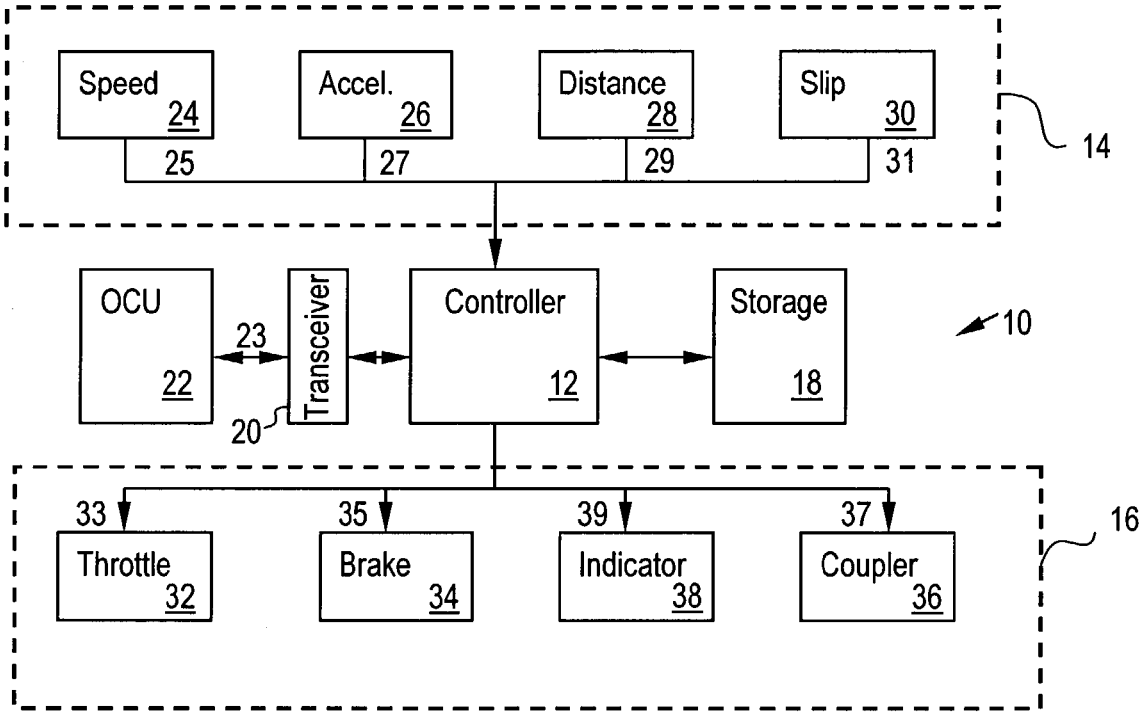
FIG. 1 is a functional diagram of an automatic coupling system for use in a locomotive.

An automatic control system 10 for use with a railroad locomotive 11 is illustrated in FIG. 1. The automatic control system 10 utilizes a controller 12 to analyze one or more input signals from sensors 14 and to produce one or more appropriate output signals to actuate systems 16 on the locomotive. The controller 12 may be in the form of a microcomputer, microcontroller, or other programmable control device as either a separate component or integral part of the locomotive operating system. As such, the controller 12 may be any known type of analog or digital device, and it may be embodied as hardware, software or firmware. In one embodiment, the control system 10 is a separate component that is adapted to be mounted to a locomotive and interfaced to mechanical, electrical, or other systems and components of the locomotive. In another embodiment, the control system 10 is an integral part of the locomotive operating system designed to communicate with the mechanical, electrical, or other systems and components of the locomotive. The function of controller 12 may be accomplished using existing digital processors already available on a locomotive by providing appropriate additional programmed instructions.

The automatic control system 10 further includes a storage media 18 such as nonvolatile memory to store the control program instructions for the controller and other data used by the system 10. Moreover, a communication module 20 such as a transceiver is provided for sending and receiving signals from a remote device (e.g., remote control system 22).

The automatic control system 10 is designed to actuate predetermined systems and components of the locomotive in response to certain conditions incident to coupling with a railcar. Conditions incident to coupling include approaching the railcar (the approach), actual contact with the railcar (the impact), and the various resulting effects of impact (the effect). Information representative of these conditions can be identified, recorded and provided to the automatic control system 10 through various sensors 14. In addition, the act of "coupling" as that term is used in this application includes a completed connection and/or the contacting of the coupler devices as they interact to make up the coupling connection, as appropriate for the context of the description.

In one embodiment, sensors of the present invention include one or more of speed sensor 24, accelerometer 26, distance sensor 28, and wheel slip sensor 30. Speed sensor 24 senses the speed of locomotive 11 and generates a responsive speed signal 25. An exemplary speed sensor as known in the art includes an axle drive sensor that provides a certain number of pulses per wheel revolution to compute the locomotive's speed. Accelerometer 26 detects an acceleration of locomotive 11 (speed change per unit of time) in either a forward or a reverse direction and generates a responsive acceleration signal 27. Distance detector 28 detects the distance between the approaching vehicles (locomotive approaching a railcar or a railcar of a train that includes the locomotive approaching another railcar) and generates a responsive distance signal 29. Distance detector 28 may be any such device known in the art, such as an ultrasonic or laser device distance detector. Distance detector 28 can preferably detect the difference between an uncoupled locomotive and one that is already coupled to one or more railcars to form a train while still being able to measure approach distance. Wheel slip sensor 30 senses a slid wheel event of the locomotive and generates a responsive slid wheel signal 31.

The locomotive systems that may be actuated by the automatic control system 10 include the locomotive throttle 32, brakes 34, automatic couplers 36, a coupling indicator 38 (e.g., alarm), and the like. The control system 10 is designed to automatically actuate one or more of these systems under certain conditions incident to coupling with a railcar.

Figure 2:
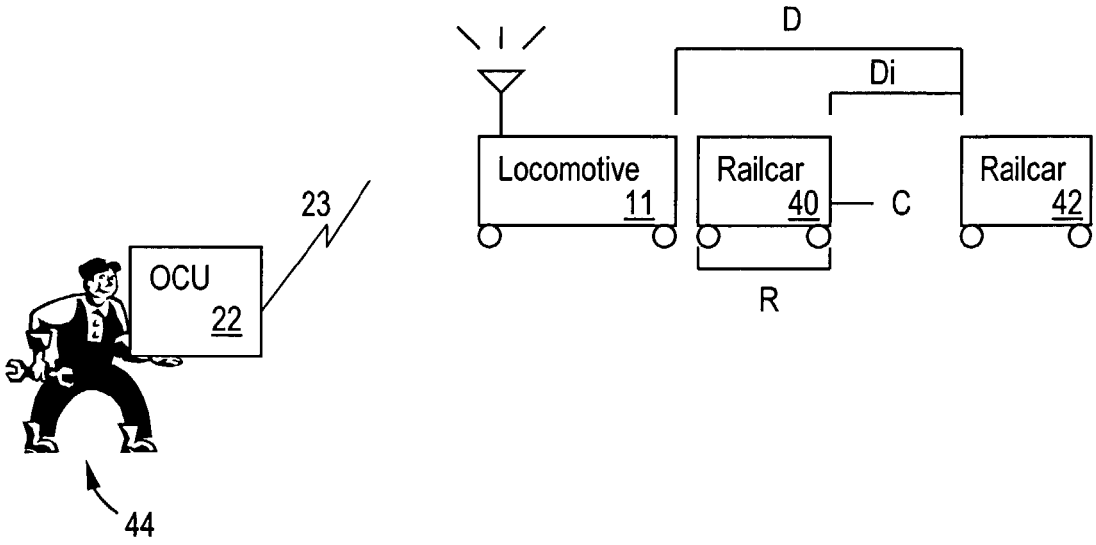
FIG. 2 is a perspective view of a remotely controlled locomotive including the automatic coupling system of FIG. 1 being coupled to a railcar.

FIG. 2 illustrates a locomotive 11 being remotely controlled by an operator 44 using a remote control system 22. Locomotive 11 is being commanded by the operator 44 to make a coupling between railcar 40, already coupled to the locomotive 11 to form a train, and railcar 42. The distance to impact is shown as Di. The length of the attached railcar 40 is shown as R. The distance between the locomotive 11 and the railcar 42 is shown as D. It can be seen therefrom that $Di=D-(N\times R)$ where N is the number of intermediate railcars. As described hereinafter, the factor D may vary depending on the type of railcar.

Automatic coupling system 10 may be incorporated into locomotive 11 to simplify the task of coupling for the remote operator 44. System 10 includes a means for detecting the approach, the impact when the approaching vehicles 40, 42 actually make contact and/or the effects of the impact. One may appreciate that system 10 will preferably work when coupling locomotive 11 (or a train including locomotive 11) directly to a railcar 40, or when coupling a group of cars including the locomotive 11 to another railcar 42, the coupling end indicated as C in FIG. 2. The means for detecting approach, impact and effect may include any one or a combination of sensors 14 as illustrated in FIG. 1.

In operation, locomotive speed sensor 24 will detect a change in speed when coupling contact is established (i.e., impact and effect) and thus the speed signal 25 provided to the controller 12 will exhibit a change (e.g., reduction) in value. Similarly, acceleration sensor 26 will detect a change in acceleration upon impact and thus acceleration signal 27 provided to controller 12 will exhibit a corresponding change when coupling contact is established. Distance sensor 28 will detect a change in distance during the approach up to the impact and thus the distance signal 29 provided to the controller 12 will exhibit a corresponding change until impact. Moreover, wheel slip sensor 30 will sense a slid wheel event of the locomotive upon impact as an effect of coupling and thus the slid wheel signal 31 provided to the controller 12 will exhibit a corresponding change. One or more of these signals indicates a condition incident to coupling. The control system 10 is designed to act upon these signals and automatically actuate one or more systems 16.

The actuated systems 16 include the locomotive throttle 32, brakes 34, automatic coupler 36, and/or indicator(s) 38 (e.g., audible or visual alarm). For example, controller 12 may be programmed to respond to one or a combination of such signals from sensors 14 to signal the actuated systems 16. Such signals may include a signal 33 to reduce the locomotive throttle 32, a signal 35 to apply the locomotive brakes 34, a signal 37 to actuate an automatic coupler device(s) 36, and/or a signal 39 to actuate an alarm or other indicator 38. These signals, alone or in combination, can be processed in numerous ways upon a coupling event so that certain locomotive systems can be activated accordingly.

Figure 3:
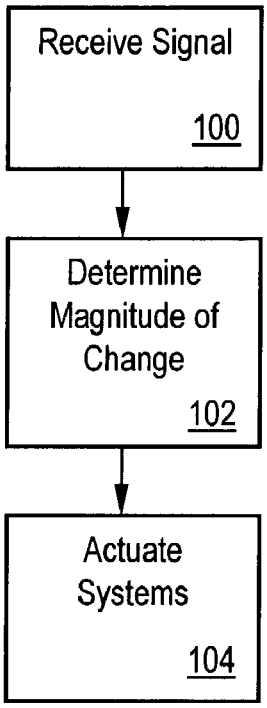
FIG. 3 is a flow chart illustrating the operation of one embodiment of the system.

For example, as shown in FIG. 3, the coupling event may be detected by utilizing the speed and/or acceleration sensors 24, 26 as follows: As shown in Step 100, the controller 12 is programmed to receive signal(s) from the speed and/or acceleration sensors 24, 26. The controller 12 determines the magnitude of the input signals from these sensors in Step 102 and controls the actuated systems in accordance with magnitude in Step 104. The magnitude would indicate whether the coupling has occurred with a light or a heavily loaded railcar 42. Thus, a sharp change in speed or a relatively large deceleration of the locomotive 11 would indicate that coupling has occurred with a heavily loaded railcar 42. Conversely, a slower change in speed or smaller deceleration of the locomotive would indicate coupling with a lighter railcar. The magnitude of the signal would then allow the controller 12 to actuate the systems on the locomotive according to whether the coupling has occurred with a light or a heavily loaded railcar 42. If coupling to a heavy railcar(s) is detected, the change in throttle 32 and/or brake 34 conditions may be programmed to be greater since the danger of wheel slip on the locomotive 11 is greater. Conversely, if coupling to a lighter railcar(s) is detected, the change in throttle 32 and/or brake 34 conditions may be programmed to be less since the danger of wheel slip on the locomotive 11 is less. Thus, the actuated systems 16 can be programmed to respond proportionally to the change sensed by the sensors 14.

In another similar example, which operates in the same manner as FIG. 3, the coupling event may be detected by utilizing the wheel slip sensors 30 as follows: The controller 12 is programmed to receive signal from the wheel slip sensor 30 by responding to the magnitude of the input signal from the sensor and to control the actuated systems in accordance with magnitude. The magnitude would indicate whether the coupling has occurred with a light or a heavily loaded railcar 42 since there is a greater chance for wheel slip upon coupling to a heavier load. Thus, greater wheel slip would indicate that coupling has occurred with a heavily loaded railcar 42. Conversely, minimal wheel slip would indicate coupling with a lighter railcar. The magnitude of the signal would then allow the controller 12 to actuate the systems on the locomotive according to whether the coupling has occurred with a light or a heavily loaded railcar 42. If coupling to a heavy railcar(s) is detected, the change in throttle 32 and/or brake 34 conditions may be programmed to be greater. Conversely, if coupling to a lighter railcar(s) is detected, the change in throttle 32 and/or brake 34 conditions may be programmed to be less.

Figure 4:
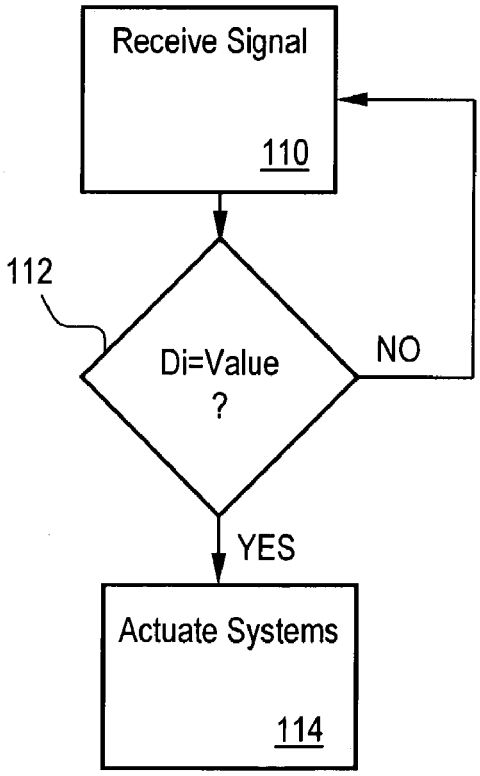
FIG. 4 is a flow chart illustrating the operation of another embodiment of the system.

In still another example, as shown in FIG. 4, the coupling event may be detected by utilizing the distance sensor 28 as follows: The controller 12 receives distance signal 29 from the distance sensor 28 in Step 110. The controller 12 then determines if such distance to impact Di has reached a predetermined value in Step 112. Upon reaching the predetermined value, appropriate systems are actuated in Step 114, such as generating a throttle signal 33 and/or brake signal 35. Controller 12 may be programmed to respond to both the magnitude of distance to impact Di and the rate of change of distance to impact Di so that locomotive systems are actuated accordingly. For example, if the rate of change of distance Di is great (indicating the approach speed may be too fast), the change in throttle 32 and/or brake 34 may be programmed to be greater or application of the brakes/decrease in the throttle may start sooner, and vice versa. Similarly, as the magnitude of the distance decreases (indicating the railcars are approaching each other) the change in throttle 32 and/or brake 34 may be programmed to be greater or application of the brakes/decrease in the throttle may start sooner, and vice versa. In another specific example, the controller 12 may be programmed to apply brakes/decrease throttle upon reaching a certain predetermined distance Di so that the impact occurs at a predetermined speed. Moreover, the controller 12 may be programmed to apply brakes/decrease throttle upon impact rather than during the approach wherein the measured distance to impact Di has reached a minimum value (the distance between two coupled cars).

If the distance sensor 28 is located on the locomotive 11, distance between the locomotive 11 and a railcar 40 would be a direct distance measurement D by means known in the art where D would equal distance to impact Di. However, once the locomotive has coupled to a railcar 40, the distance D between the locomotive 11 and the next railcar 42 would necessarily be greater than the distance to impact Di as shown in FIG. 2. Accordingly, the length of the intermediate railcar R would be taken into account when calculating the distance to impact Di and would be measured by the following formula: $Di=D-(N\times R)$ where Di is distance to impact, D is distance between the locomotive and the next railcar to be coupled, N is the number of intermediate railcars and R is the length of the intermediate railcars (provided all railcars are approximately the same length). The number N could be automatically incremented upon each coupling event or transmitted to the controller 12 by the operator/engineer. The formula would be appropriately adjusted if railcars were of varying length. If, on the other hand, the distance sensors were located on each railcar, then the distance to impact Di could be directly measured and communicated to the controller 12.

Upon sensing a coupling event (via wheel slip sensor, distance sensor, speed/accelerator sensor), the controller may signal an automatic coupler 36 to complete mechanical and electrical coupling of the railcars. A signal 39 may then be activated (or transmitted) to signal the coupling event.

When operating the automatic coupling system 10 in combination with a remote control system 22, communication between the coupling system 10 and the remote control system 22 is provided by control signals 23 transmitted between the systems. These control signals 23 transmitted between the systems may be used to transmit information and data between the systems, including signals to active and deactivate the automatic coupling system 10, receive alarms from the automatic coupling system 10, and override the coupling system 10 to allow for remote actuation of locomotive systems.

In operation, the automatic coupling system 10 may be engaged by an operator by transmitting a start signal from the remote control system 22 (e.g., using an operator control unit (OCU)) to the automatic coupling system 10. Upon receiving the start signal, the control of locomotive 11 is no longer controlled by the OCU, but rather is controlled by the automatic coupling system 10. The system 10 may include the capability for the operator to truncate the coupling sequence by appropriate manipulation of OCU. Once coupling is detected by controller 12, an indicator signal 39 indicative of coupling may be sent back to the OCU. This signal 39 may be in the form of a "coupling-complete signal" and may be sent to an output device located in the OCU. The output device may provide a visual and/or audible annunciation of the coupling event. Once coupling is completed, normal remote control functionality is returned to the OCU. Additional data from the OCU may be sent to the automatic control system 10, such as data representative of the number of intermediate railcars N, or the length of the railcar R, to use in the calculation of distance to impact Di as set forth previously.

While the automatic coupling system 10 is illustrated as being used with a remote control system 22, such an automatic coupling system may also be used when an engineer in the locomotive cab is controlling the operation of the locomotive 11.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A coupling control apparatus for controlling a locomotive upon coupling a train that includes at least coupling the locomotive to a railcar, the apparatus comprising:

a sensor for monitoring a coupling parameter indicative of the occurrence of a coupling contact and generating a coupling signal responsive to the coupling contact; and programmed instructions executable by a controller for at least one of applying a brake of the locomotive and decreasing a throttle of the locomotive in order to control wheel slip of the locomotive incident to the coupling contact in response to the coupling signal;

wherein the coupling signal is responsive to locomotive speed.

2. A coupling control apparatus for controlling a locomotive upon coupling a train that includes at least coupling the locomotive to a railcar, the apparatus comprising:

a sensor for monitoring a coupling parameter indicative of the occurrence of a coupling contact and generating a coupling signal responsive to the coupling contact; and programmed instructions executable by a controller for at least one of applying a brake of the locomotive and decreasing a throttle of the locomotive in order to control wheel slip of the locomotive incident to the coupling contact in response to the coupling signal;

wherein the coupling signal is responsive to locomotive deceleration.

3. The apparatus of claim 2, wherein the controller responds to a change in the coupling signal upon coupling to the railcar to effect a change in the speed of the locomotive.

4. The apparatus of claim 3, wherein the signal is responsive to a change in locomotive speed.

5. The apparatus of claim 3, wherein the signal is responsive to a change in locomotive acceleration.

6. A coupling control apparatus for controlling a locomotive upon coupling a train that includes at least coupling the locomotive to a railcar, the apparatus comprising:

a sensor for monitoring a coupling parameter indicative of the occurrence of a coupling event and generating a coupling signal responsive to the coupling event; and programmed instructions executable by a controller for controlling the locomotive incident to the coupling event in response to the coupling signal;

wherein the signal is responsive to locomotive wheel slip.

7. A coupling control apparatus for controlling a locomotive upon coupling a train that includes at least coupling the locomotive to a railcar, the apparatus comprising:

a sensor for monitoring a coupling parameter indicative of the occurrence of a coupling contact and generating a coupling signal responsive to the coupling contact; and programmed instructions executable by a controller for at least one of applying a brake of the locomotive and decreasing a throttle of the locomotive in order to control wheel slip of the locomotive incident to the coupling event in response to the coupling signal;

wherein the sensor comprises a speed sensor.

8. A coupling control apparatus for controlling a locomotive upon coupling a train that includes at least coupling the locomotive to a railcar, the apparatus comprising:

a sensor for monitoring a coupling parameter indicative of the occurrence of a coupling contact and generating a coupling signal responsive to the coupling contact; and programmed instructions executable by a controller for at least one of applying a brake of the locomotive and decreasing a throttle of the locomotive in order to control wheel slip of the locomotive incident to the coupling contact in response to the coupling signal;

wherein the sensor comprises an accelerometer.

9. The apparatus of claim 8, wherein the controller communicates with a throttle control device for controlling a throttle of the locomotive.

10. The apparatus of claim 8, wherein the controller communicates with a brake control device for controlling a brake of the locomotive.

11. The apparatus of claim 8, wherein the controller communicates with an automatic coupler.

12. The apparatus of claim 8, further comprising a communication module for communicating with a remote control device.

13. The apparatus of claim 12, wherein the remote device controls activation of the coupling control apparatus.

14. The apparatus of claim 12, wherein the wherein the controller transmits a signal to the remote control device upon the coupling event.

15. A coupling control apparatus for controlling a locomotive upon coupling a train that includes at least coupling the locomotive to a railcar, the apparatus comprising:

a sensor for monitoring a coupling parameter indicative of the occurrence of a coupling event and generating a coupling signal responsive to the coupling event; and programmed instructions executable by a controller for controlling the locomotive incident to the coupling event in response to the coupling signal;

wherein the sensor comprises a wheel slip sensor.

16. A coupling control apparatus for controlling a locomotive upon coupling a train that includes at least coupling the locomotive to a railcar, the apparatus comprising:

a sensor for monitoring a coupling parameter indicative of the occurrence of a coupling event and generating a coupling signal responsive to the coupling event; and programmed instructions executable by a controller for controlling the locomotive incident to the coupling event in response to the coupling signal;

wherein the controller communicates with an indicator for providing an output signal upon coupling of the locomotive to the railcar.

17. A method for controlling movement of a locomotive for coupling a train that includes at least the locomotive to a railcar, comprising:

generating a signal indicative of a coupling contact between a locomotive and a railcar; and controlling at least one of a brake of the locomotive and a throttle of the locomotive in order to control wheel slip the locomotive based on said signal;

further comprising generating the signal to be responsive to locomotive speed.

18. A method for controlling movement of a locomotive for coupling a train that includes at least the locomotive to a railcar, comprising:

generating a signal indicative of a coupling contact between a locomotive and a railcar; and controlling at least one of a brake of the locomotive and a throttle of the locomotive in order to control wheel slip of the locomotive based on said signal;

further comprising generating the signal to be responsive to locomotive acceleration.

19. A method for controlling movement of a locomotive for coupling a train that includes at least the locomotive to a railcar, comprising:

generating a signal indicative of a coupling event between a locomotive and a railcar; and controlling a system of the locomotive based on said signal;

further comprising generating the signal to be responsive to locomotive wheel slip.

20. A method for controlling movement of a locomotive for coupling a train that includes at least the locomotive to a railcar, comprising:

generating a signal indicative of a coupling event between a locomotive and a railcar; and controlling a system of the locomotive based on said signal;

wherein controlling the movement of the locomotive comprises generating a command to avoid wheel slip upon coupling to the railcar.

21. A method for controlling movement of a locomotive for coupling a train that includes at least the locomotive to a railcar, comprising:

generating a signal indicative of a coupling event between a locomotive and a railcar; and controlling a system of the locomotive based on said signal;

wherein the signal is responsive to a distance measurement between the locomotive and the railcar to indicate a distance to impact; and wherein the distance measurement between the locomotive and the railcar is adjusted to account for any intermediate railcars already coupled to the locomotive to indicate the distance to impact.

22. The method of claim 21, wherein data representative of a number of intermediate railcars is automatically incremented upon coupling.

23. A remote control apparatus for controlling the movement of a locomotive upon coupling a train that includes at least the locomotive to a railcar, comprising:

a locomotive remote control system comprising an operator control unit;

a sensor for generating a coupling signal indicative of a coupling contact that couples the train to a railcar; and a controller responsive to the operator control unit and the coupling signal for at least one of applying a brake of the locomotive and decreasing a throttle of the locomotive in order to control wheel slip of the locomotive incident to the coupling contact;

wherein the sensor is a speed sensor.

24. A remote control apparatus for controlling the movement of a locomotive upon coupling a train tat includes at least the locomotive to a railcar, comprising:

a locomotive remote control system comprising an operator control unit;

a sensor for generating a coupling signal indicative of a coupling contact that couples the train to a railcar; and a controller responsive to the operator control unit and the coupling signal for at least one of applying a brake of the locomotive and decreasing a throttle of the locomotive in order to control wheel slip of the locomotive incident to the coupling event;

wherein the sensor is an accelerometer.

25. The remote control apparatus of claim 24, wherein the controller comprises part of an automatic coupling system.

26. A remote control apparatus for controlling the movement of a locomotive upon coupling a train that includes at least the locomotive to a railcar, comprising:

a locomotive remote control system comprising an operator control unit;

a sensor for generating a coupling signal indicative of a coupling event that couples the train to a railcar; and a controller responsive to the operator control unit and the coupling signal for controlling the operation of the locomotive incident to the coupling event;

wherein the sensor is a wheel slip sensor.

27. A method for controlling movement of a locomotive for coupling a train that includes at least the locomotive to a railcar, the method comprising:

providing a remote control system comprising an operator control unit for controlling the locomotive remotely;

transmitting a start signal from the operator control unit to initiate a coupling sequence controlled by an automatic coupling system;

generating a coupling-complete signal indicative of a coupling event; and returning control of the locomotive to the operator control unit in response to the coupling-complete signal;

further comprising inputting data to the automatic coupling system for use during the coupling sequence via the operator control unit.

28. A remote control apparatus for controlling the movement of a locomotive upon coupling a train that includes at least the locomotive to a railcar, comprising:

a locomotive remote control system comprising an operator control unit;

a sensor for generating a coupling signal indicative of a coupling event that couples the train to a railcar; and a controller responsive to the operator control unit and the coupling signal for controlling the operation of the locomotive incident to the coupling event;

wherein the sensor is an accelerometer;

wherein the controller comprises part of an automatic coupling system; and further comprising:

a start signal transmitted from the remote control system to engage the automatic coupling system and effective to transfer control of the locomotive from the operator control unit to the automatic coupling system; and a coupling-complete signal transmitted from the automatic coupling system to the remote control system in response to the coupling signal and effective to return control of the locomotive to the operator control unit.

* * * * *